US006588316B1

(12) United States Patent
Armitage

(10) Patent No.: US 6,588,316 B1
(45) Date of Patent: Jul. 8, 2003

(54) PNEUMATIC COLLET CONTROL SYSTEM

(76) Inventor: George Armitage, 7039 Jefferson St., P.O. Box 725, New Port Richey, FL (US) 34656-0725

( * ) Notice: Subject to any disclaimer, the term of this patent is extended or adjusted under 35 U.S.C. 154(b) by 0 days.

(21) Appl. No.: 10/022,937

(22) Filed: Dec. 17, 2001

(51) Int. Cl.[7] ..... F15B 11/08

(52) U.S. Cl. ..... 92/169.1; 279/4.08; 92/161

(58) Field of Search ..... 92/129, 161, 164, 92/169.1; 91/465; 248/200, 213.2; 279/4.07, 4.08, 4.09, 2.06; 137/636.2, 596

(56) References Cited

U.S. PATENT DOCUMENTS 2,366,908 A * 1/1945 Jenkins ..... 279/4.08
2,543,857 A * 3/1951 Liefer ..... 279/4.08
3,612,384 A * 10/1971 Loyd et al. ..... 279/4.08
4,080,992 A * 3/1978 Niederer ..... 137/596
5,456,161 A * 10/1995 Yuda et al. ..... 92/169.1
6,223,649 B1 * 5/2001 Beck et al. ..... 92/169.1

* cited by examiner

*Primary Examiner*—Edward K. Look
*Assistant Examiner*—Thomas E. Lazo
(74) *Attorney, Agent, or Firm*—Edward A. Dutkiewicz

(57) ABSTRACT

A pneumatic collet control system has a pneumatic cylinder subassembly with an internal shuttle subassembly with a central cylinder portion having an internal surface and a plurality of passageway holes on opposite ends of the cylinder communicating with the internal surface. The internal shuttle subassembly having a ram and a piston. A collet arm coupler is threadedly received into the external end of the ram. A valve body subassembly has a pair of valves and a pair of passageways for the valves for allowing and controlling the flow of actuating fluid into the cylinder with the passageways aligning with and coupling to the passageway holes of the cylinder. A central actuating fluid passageway connects with the two valves. A rotatable flow direction arm with a pivotable operator controlled handle controls the flow of actuating fluid into the cylinder.

2 Claims, 3 Drawing Sheets

50
70
10
2
2
3
3

88
86
34
58
66
72
68
90
92

PNEUMATIC COLLET CONTROL SYSTEM

BACKGROUND OF THE INVENTION

1. Field of the Invention

The present invention relates to a pneumatic collet control system and more particularly pertains to opening and closing of collet of an automatic screw machine in a safe and convenient manner.

2. Description of the Prior Art

The use of collet opening and closing mechanisms of known designs and configurations is known in the prior art. More specifically, collet opening and closing mechanisms of known designs and configurations previously devised and utilized for the purpose of operating automatic screw machines through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,014,558 to Brinkman discloses a chuck-closing mechanism for automatic screw machine. U.S. Pat. No. 5,002,291 to Reed et al. discloses a hydraulically operated check closing mechanism. Lastly, U.S. Pat. No. 4,799,696 to Reed et al. discloses a chuck closing mechanism for automatic screw machine.

While these devices fulfill their respective, particular objectives and requirements, the aforementioned patents do not describe a pneumatic collet control system that allows opening and closing of collet of an automatic screw machine in a safe and convenient manner.

In this respect, the pneumatic collet control system according to the present invention substantially departs from the conventional concepts and designs of the prior art, and in doing so provides an apparatus primarily developed for the purpose of opening and closing of collet of an automatic screw machine in a safe and convenient manner.

Therefore, it can be appreciated that there exists a continuing need for a new and improved pneumatic collet control system which can be used for opening and closing of collet of an automatic screw machine in a safe and convenient manner. In this regard, the present invention substantially fulfills this need.

SUMMARY OF THE INVENTION

In view of the foregoing disadvantages inherent in the known types of collet opening and closing mechanisms of known designs and configurations now present in the prior art, the present invention provides an improved pneumatic collet control system. As such, the general purpose of the present invention, which will be described subsequently in greater detail, is to provide a new and improved pneumatic collet control system and method which has all the advantages of the prior art and none of the disadvantages.

To attain this, the present invention essentially comprises a mounting bracket. The mounting bracket is fabricated of a rigid material and has a generally L-shaped configuration. A mounting leg has two bolt holes a 90 degree second leg terminating in a transverse mounting pin. A pneumatic cylinder subassembly is next provided. The pneumatic cylinder subassembly is coupled to the recipient sides. The subassembly is fabricated of a rigid material and has a mounting bracket portion and a central cylinder portion. The pneumatic cylinder subassembly also has an end cap and an internal shuttle subassembly. The mounting bracket portion has two protruding legs forming a clevis with holes for rotatably receiving the pin. The central cylinder portion has an internal surface forming a round internal cylindrically-shaped hole through its length. A retaining clip groove is provided on the end cap end of the cylinder. The central cylinder portion also has an external surface. The central cylinder portion has a wall between the external and internal surfaces. The external surface has a plurality of reinforcing bosses running lengthwise the length of the cylinder portion. The external cylinder has a plurality of passageway holes on opposite ends of the cylinder communicating with the internal surface and a plurality of threaded bolt recesses into the wall of the cylinder. The end cap has a round flat cylindrical shape with a central hole. The cap is sized to fit securely within the internal diameter of the cylinder. The internal shuttle subassembly has a ram and a piston. The ram has an internal end and an external end. The internal end couples with the piston. The external end has a threaded recess. Next provided is a fastener. The fastener functions to hold the end cap within the internal diameter of the cylinder. Next provided is a collet arm coupler. The collet arm coupler has a flat outer portion and a round threaded inner portion. The outer portion has a central oval slot and a round shaft sized to be received within the central slot. The threaded inner portion is threadedly received into the threaded recess of the external end of the ram. A valve body subassembly is next provided. The valve body subassembly is fabricated of rigid material. The valve body subassembly has a valve housing. The valve housing has a generally rectilinear configuration. The valve body subassembly has a pair of valves and a pair of passageways for the valves for allowing and controlling the flow of actuating fluid into the cylinder. Coil spring urge the valves upwardly when pressure is relieved. The passageways align with and couple to the passageway holes of the cylinder. A central actuating fluid passageway connects with the two valves and a rotatable flow direction arm with a pivotable operator controlled handle for controlling the flow of actuating fluid into the cylinder. Rocker arms sequentially move the valves in response to shifting of the handle and rotation of the flow directing arm. The valve housing has a plurality of holes with bolts for threadedly mounting the valve subassembly onto the external wall of the cylinder. Finally, a coupler is next provided. The coupler securely couples the central actuating passageway to a source of actuating fluid.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved pneumatic collet control system which has all of the advantages of the prior art collet opening and closing mechanisms of known designs and configurations and none of the disadvantages.

It is another object of the present invention to provide a new and improved pneumatic collet control system which may be easily and efficiently manufactured and marketed.

It is further object of the present invention to provide a new and improved pneumatic collet control system which is of durable and reliable constructions.

An even further object of the present invention is to provide a new and improved pneumatic collet control system which is susceptible of a low cost of manufacture with regard to both materials and labor, and which accordingly is then susceptible of low prices of sale to the consuming public, thereby making such pneumatic collet control system economically available to the buying public.

Even still another object of the present invention is to provide a pneumatic collet control system for opening and closing of collet of an automatic screw machine in a safe and convenient manner.

Lastly, it is an object of the present invention to provide a new and improved pneumatic collet control system having a pneumatic cylinder subassembly with an internal shuttle subassembly with a central cylinder portion having an internal surface and a plurality of passageway holes on opposite ends of the cylinder communicating with the internal surface. The internal shuttle subassembly having a ram and a piston. A collet arm coupler is threadedly received into the external end of the ram. A valve body subassembly has a pair of valves and a pair of passageways for the valves for allowing and controlling the flow of actuating fluid into the cylinder with the passageways aligning with and coupling to the passageway holes of the in cylinder. A central actuating fluid passageway connects with the two valves. A rotatable flow direction arm with a pivotable operator controlled handle controls the flow of actuating fluid into the cylinder.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
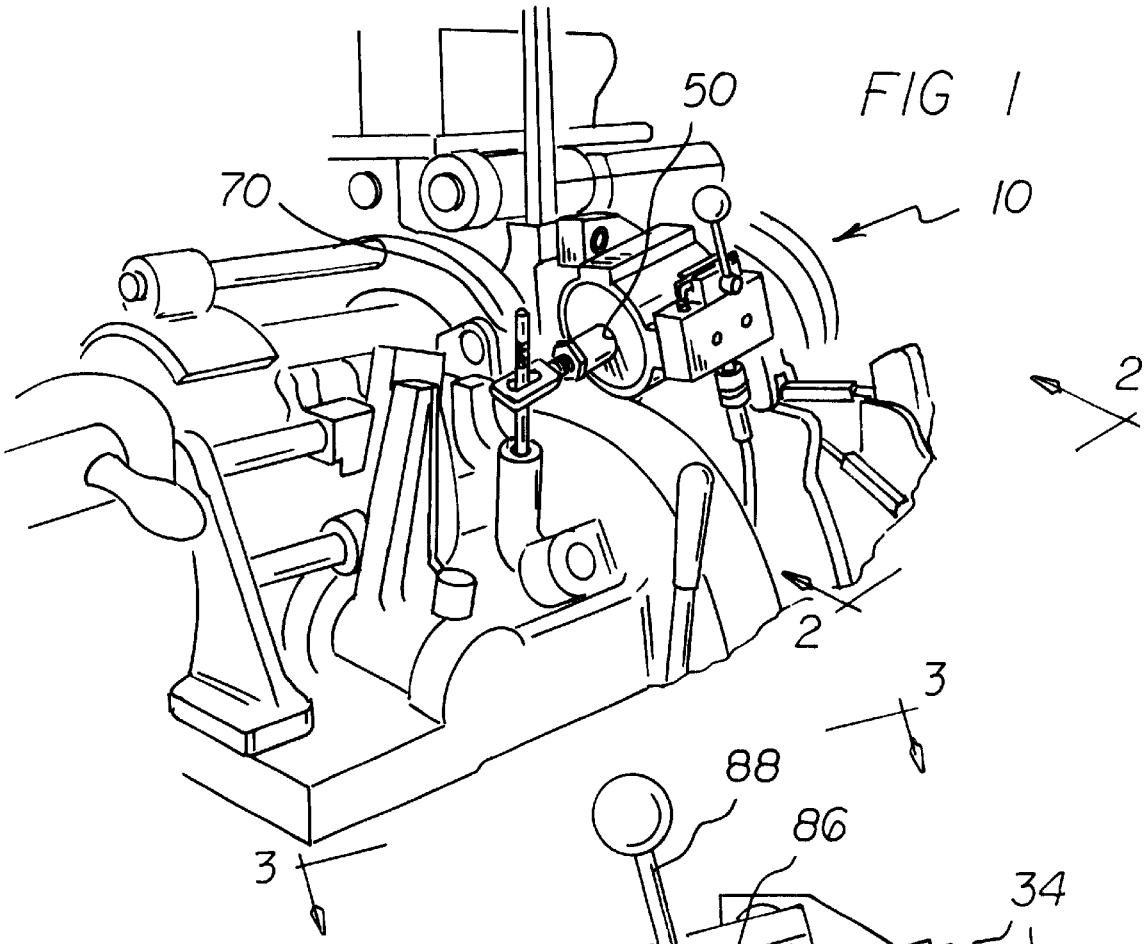
FIG. 1 is perspective illustration of a collet control system constructed in accordance with the principals of the present invention.
Figure 2:
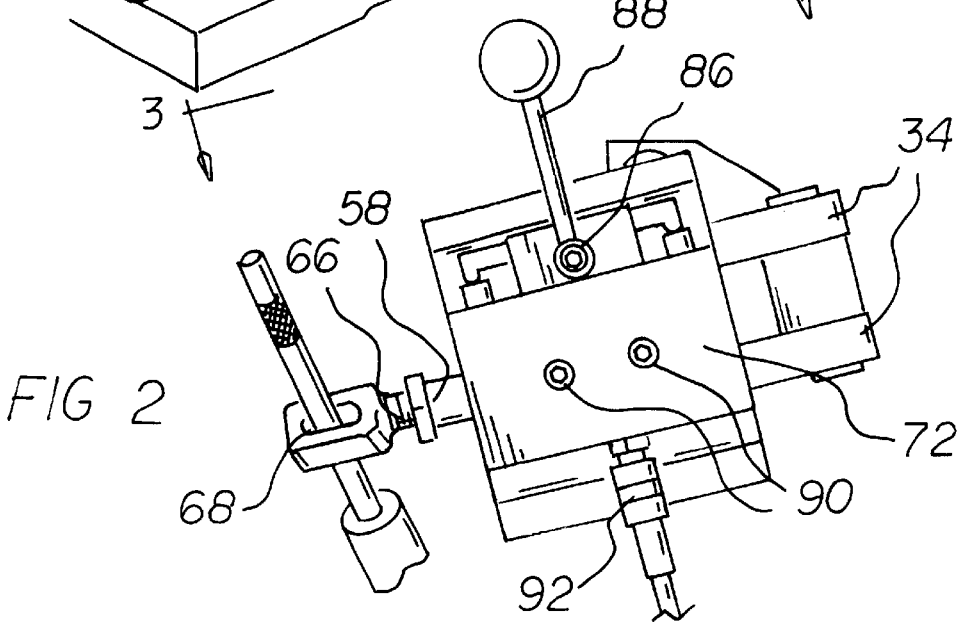
FIG. 2 is a front elevational view of the system taken along line 2—2 of FIG. 1.
Figure 3:
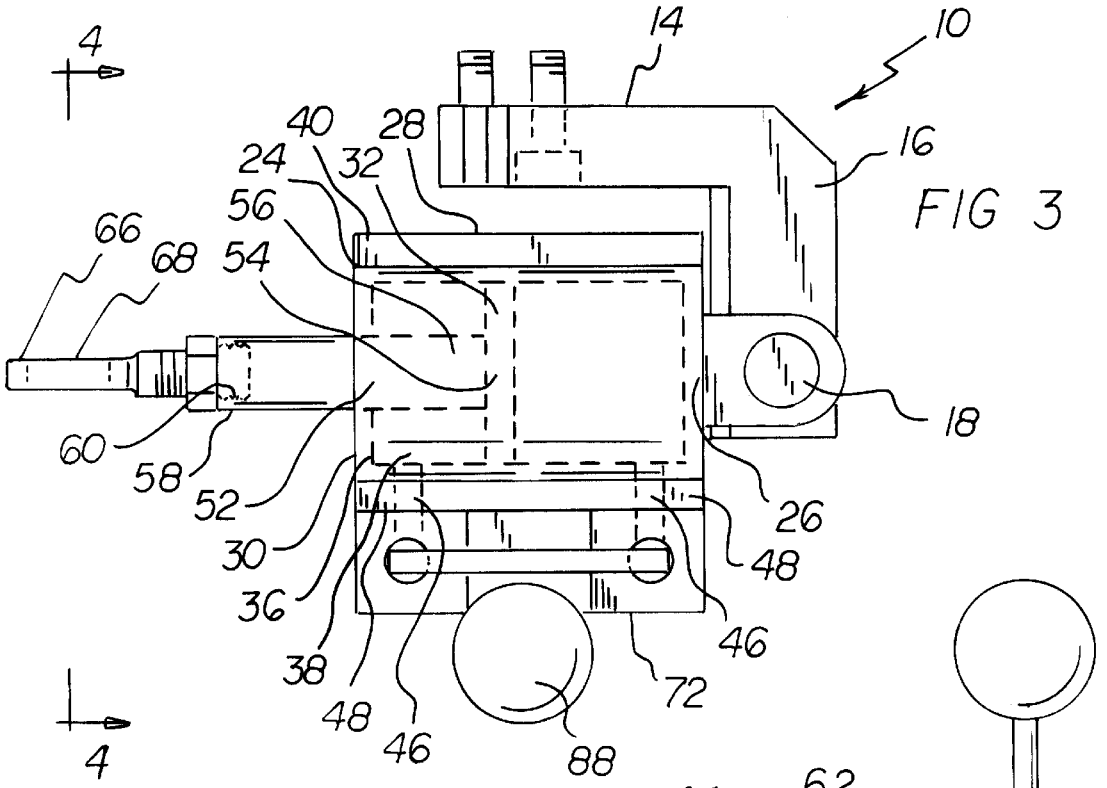
FIG. 3 is a top elevational view of the system taken along line 3—3 of FIG. 4.
Figure 4:
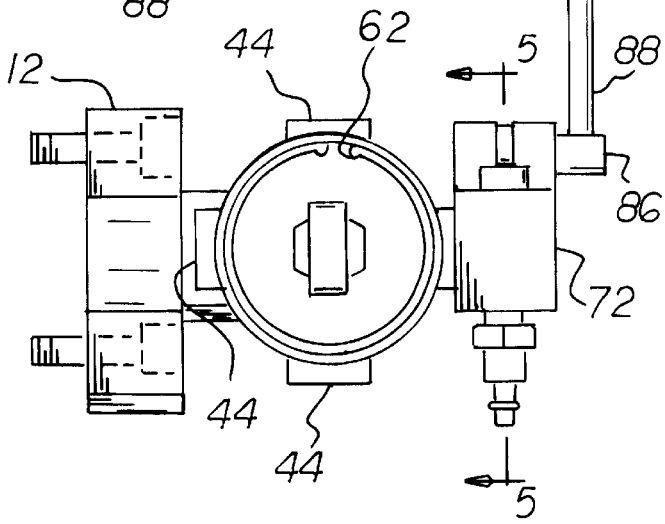
FIG. 4 is an end elevational view of the system taken along line 4—4 of FIG. 3.
Figure 5:
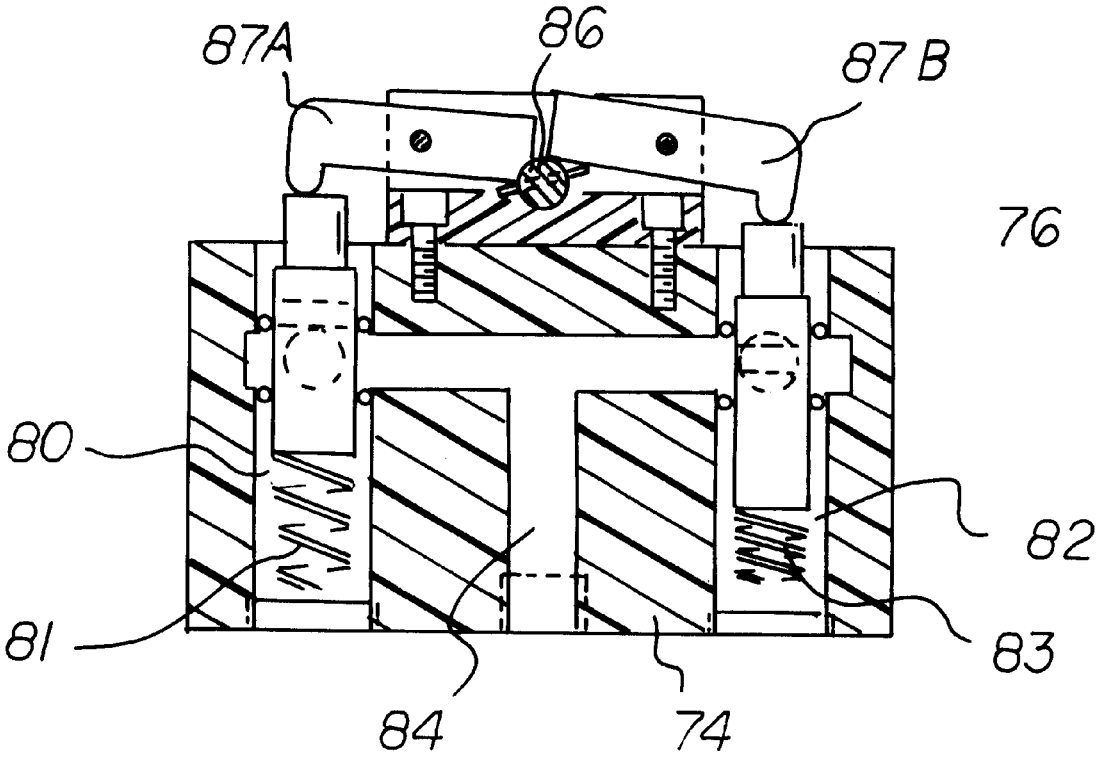
FIG. 5 is a cross-sectional view taken along 5—5 of FIG. 4.

With reference now to the drawings, and in particular to FIG. 1 thereof, the preferred embodiment of the new and improved pneumatic collet control system embodying the principles and concepts of the present invention and generally designated by the reference numeral 10 will be described.

The present invention, the pneumatic collet control system 10 is comprised of a plurality of components. Such components in their broadest context include a pneumatic collet control system, a collet arm coupler, and a valve body subassembly. Such components are individually configured and correlated with respect to each other so as to attain the desired objective.

First provided is a mounting bracket 12. The mounting bracket is fabricated of a rigid material and has a generally L-shaped configuration. A mounting leg 14 has two bolt holes and a 90 degree second leg 16 terminating in a transverse mounting pin;

A pneumatic cylinder subassembly 24 is next provided. The pneumatic cylinder subassembly is coupled to the recipient sides. The subassembly is fabricated of a rigid material and has a mounting bracket portion 26 and a central cylinder portion 28. The pneumatic cylinder subassembly also has an end cap 30 and an internal shuttle subassembly 32. The mounting bracket portion has two protruding legs 34 forming a clevis with holes for rotatably receiving the pin 18. The central cylinder portion 36 has an internal surface forming a round internal cylindrically-shaped hole 38 through its length. A retaining clip groove 40 is provided on the end cap end of the cylinder. The central cylinder portion also has an external surface. The central cylinder portion has a wall between the external and internal surfaces. The external surface has a plurality of reinforcing bosses 44 running lengthwise the length of the cylinder portion. The external cylinder has a plurality of passageway holes 46 on opposite ends of the cylinder communicating with the internal surface and a plurality of threaded bolt recesses 48 into the wall of the cylinder. The end cap has a round flat cylindrical shape with a central hole 50. The cap is sized to fit securely within the internal diameter of the cylinder. The internal shuttle subassembly has a ram 52 and a piston 54. The ram has an internal end 56 and an external end 58. The internal end couples with the piston. The external end has a threaded recess 60.

Next provided is a fastener 62. The fastener functions to hold the end cap within the internal diameter of the cylinder.

Next provided is a collet arm coupler 66. The collet arm coupler has a flat outer portion and a round threaded inner portion. The outer portion has a central oval slot 68 and a round shaft 70 sized to be received within the central slot. The threaded inner portion is threadedly received into the threaded recess of the external end of the ram.

A valve body subassembly 72 is next provided. The valve body subassembly is fabricated of rigid material. The valve body subassembly has a valve housing 74. The valve housing has a generally rectilinear configuration. The valve body subassembly has a pair of valves and a pair of passageways 80, 82 for the valves for allowing and controlling the flow of actuating fluid into the cylinder. Coil springs 81, 83 urge the valves upwardly when pressure is relieved. The passageways align with and couple to the passageway holes of the cylinder. A central actuating fluid passageway 84 connects with the two valves and a rotatable flow direction arm 86 with a pivotable operator controlled handle 88 for controlling the flow of actuating fluid into the cylinder. Rocker arms 87A, 87B sequentially move the valves in response to shifting of the handle and rotation of the flow directing arm. The valve housing has a plurality of holes with bolts 90 for threadedly mounting the valve subassembly onto the external wall of the cylinder.

Finally, a coupler 92 is next provided. The coupler securely couples the central actuating passageway to a source of as actuating fluid.

The present invention relates to improvements in a screw machine such as a conventional Davenport screw machine. In using the machine, normally every 15 minutes new bar stock must be supplied. When such is supplied and new bar stock is added, the collet must be opened to push out the stub from the old feed stock and to allow entry of the new feed stock. Consequently, every 15 minutes the operator must pivot a leaver to open and close the collet. Companies have attempted a pneumatic system for effecting such change. Such machines are expensive and complex units requiring supplemental drilling of attachment holes on the machine. The present invention is a simplified pneumatic version which mounts to existing holes above and to the right and closer to the collet pivoting rod. By pivoting a pneumatic lever in one direction, a pressure will open the collet and by pushing in the opposite direction will close the collet. Formerly this was a very laborious task requiring a strong operator to run it. Fitted with the existing new invention an operator of lesser strength can operate the system in a more efficient manner without detracting from the strength and rigidity of the existing screw machine. Note is taken that to operate properly, one must open and close the collet for each new bar stock.

The pneumatic collet control system of the present invention is readily adapted to be installed on an automatic screw machine such as a Davenport screw machine. Installation normally takes about 5 minutes, using the rear transfer arm holes in the rotating head cap. The rear transfer holes are first cleaned out. It may be necessary to clean the holes with a ⅝ inch tap. The head is then rotated to the stock loading position. The bracket is then installed with bolts which are included. Next, the air cylinder is installed by dropping the main pin which is also included. Lastly, the installer savings the air cylinder into the pivot position, then drops the knurled pin into the collet closing mechanism, the knurled pin being included, and finally installs the shuttle handle with the round knob up and tightens the set screw. Caution should be taken to pull the piston rod manually to the fully extended position and to use the pivot pin to adjust the edge bolt to exert pressure against the work spindle fiber washer. Connection through a ⅜ inch diameter air line is recommended with a minimum pressure of 120 pounds per square inch.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A pneumatic collet control system for allowing a user to safely and conveniently control an automatic screw machine collet comprising, in combination;

a mounting bracket fabricated of a rigid material and having a generally L-shaped configuration with a mounting leg having two bolt holes and a 90 degree second leg with recipient sides and terminating in a transverse mounting pin;

a pneumatic cylinder subassembly coupled to the recipient sides of the second leg through the mounting pin and fabricated of rigid material and having a mounting bracket portion and a central cylinder portion and an end cap and an internal shuttle subassembly, with the mounting bracket portion having two protruding legs forming a clevis with holes for rotatably receiving the pin and the central cylinder portion having an internal surface forming a round internal cylindrically-shaped hole through its length with a retaining clip groove on the end cap end of the cylinder and having an external surface with a wall there between, the external surface having a plurality of reinforcing bosses running lengthwise the length of the cylinder portion with the external cylinder having a plurality of passageway holes on opposite ends of the cylinder communicating with the internal surface and a plurality of threaded bolt recesses into the wall of the cylinder with the end cap having a round flat cylindrical shape with a central hole and the cap sized to fit securely within the internal diameter of the cylinder and the internal shuttle subassembly having a ram and a piston with the ram having an internal end and an external end with the internal end coupling with the piston and the external end having a threaded recess;

a fastener to hold the end cap within the internal diameter of the cylinder;

a collet arm coupler having a flat outer portion and a round threaded inner portion with the outer portion having a central oval slot and a round shaft sized to be received within the central slot and with the threaded inner portion being threadedly received into the threaded recess of the external end of the ram;

a valve body subassembly fabricated of rigid material with a valve housing having a generally rectilinear configuration with the subassembly having pair of valves and a pair of passageways for the valves for allowing and controlling the flow of actuating fluid into the cylinder with oil springs urging the valves upwardly when pressure is relieved and with the passageways aligning with and coupling to the passageway holes of the cylinder and a central actuating fluid passageway connecting with the two valves and a rotatable flow direction arm with a pivotable operator controlled handle for controlling the flow of actuating fluid into the cylinder, with rocker arms to sequentially move the valves in response to the shifting of the handle and rotation of the flow directing arm and with the valve housing having a plurality of holes with bolts for threadedly mounting the valve subassembly onto the external wall of the cylinder; and a coupler for securely coupling the central actuating passageway to a source of actuating fluid.

2. A pneumatic collet control system comprising;

a mounting bracket fabricated of a rigid material and having a generally L-shaped configuration with a mounting leg having two bolt holes and a 90 degree second leg and with recipient sides and terminating in a transverse mounting pin;

a pneumatic cylinder subassembly coupled to the recipient sides of the second leg through the mounting pin and fabricated of rigid material and having a mounting bracket portion and a central cylinder portion and an end cap and having an internal shuttle subassembly with a central cylinder portion having an internal surface and a plurality of passageway holes on opposite ends of the cylinder communicating with the internal surface, the internal shuttle subassembly having a ram and a piston;

a collet arm coupler threadedly received into the external end of the ram;

a valve body subassembly having a pair of valves and a pair of passageways for the valves for allowing and controlling the flow of actuating fluid into the cylinder with the passageways aligning with and coupling to the passageway holes of the cylinder and a central actuating fluid passageway connecting with the two valves and a rotatable flow direction arm with a pivotable operator controlled handle for controlling the flow of actuating fluid into the cylinder; and means to couple the system to an automatic screw machine.

* * * * *